United States Patent [19]

Hüeller

[11] 4,171,611

[45] Oct. 23, 1979

[54] VEHICULAR GAS TURBINE SYSTEM

[75] Inventor: Josef Hüeller, Munich, Fed. Rep. of Germany

[73] Assignee: Motoren- und Turbinen-Union Munchen GmbH, Muenchen-Allach, Fed. Rep. of Germany

[21] Appl. No.: 882,657

[22] Filed: Mar. 2, 1978

Related U.S. Application Data

[63] Continuation of Ser. No. 710,291, Jul. 30, 1976, abandoned.

[30] Foreign Application Priority Data

Aug. 7, 1975 [DE] Fed. Rep. of Germany ..... 2535220

[51] Int. Cl.[2] ..... F02C 7/06

[52] U.S. Cl. ..... 60/39.08; 60/39.16 R; 184/6.11

[58] Field of Search ..... 60/39.08, 39.16 R, 39.17; 184/6.4, 6.11; 123/196 R; 417/13, 281

[56] References Cited

U.S. PATENT DOCUMENTS

| | | | |
|---|---|---|---|
| 2,604,188 | 7/1952 | Marchant | 184/6.11 |
| 2,711,071 | 6/1955 | Frankel | 60/39.08 |
| 2,984,975 | 5/1961 | Rodgers et al. | 60/39.08 |
| 3,147,821 | 9/1964 | Eggenberger | 123/196 R |
| 3,621,657 | 11/1971 | Jurisch et al. | 60/39.16 R |
| 3,779,345 | 12/1973 | Barnes et al. | 60/39.08 |
| 4,002,224 | 1/1977 | Easter | 60/39.08 |

*Primary Examiner*—Robert E. Garrett

*Attorney, Agent, or Firm*—W. G. Fasse; W. W. Roberts

[57] ABSTRACT

This invention relates to a gas turbine system having a gas generator, a power turbine, and a pump driven by said gas generator to provide bearing areas of especially the power turbine with lubricant.

3 Claims, 1 Drawing Figure

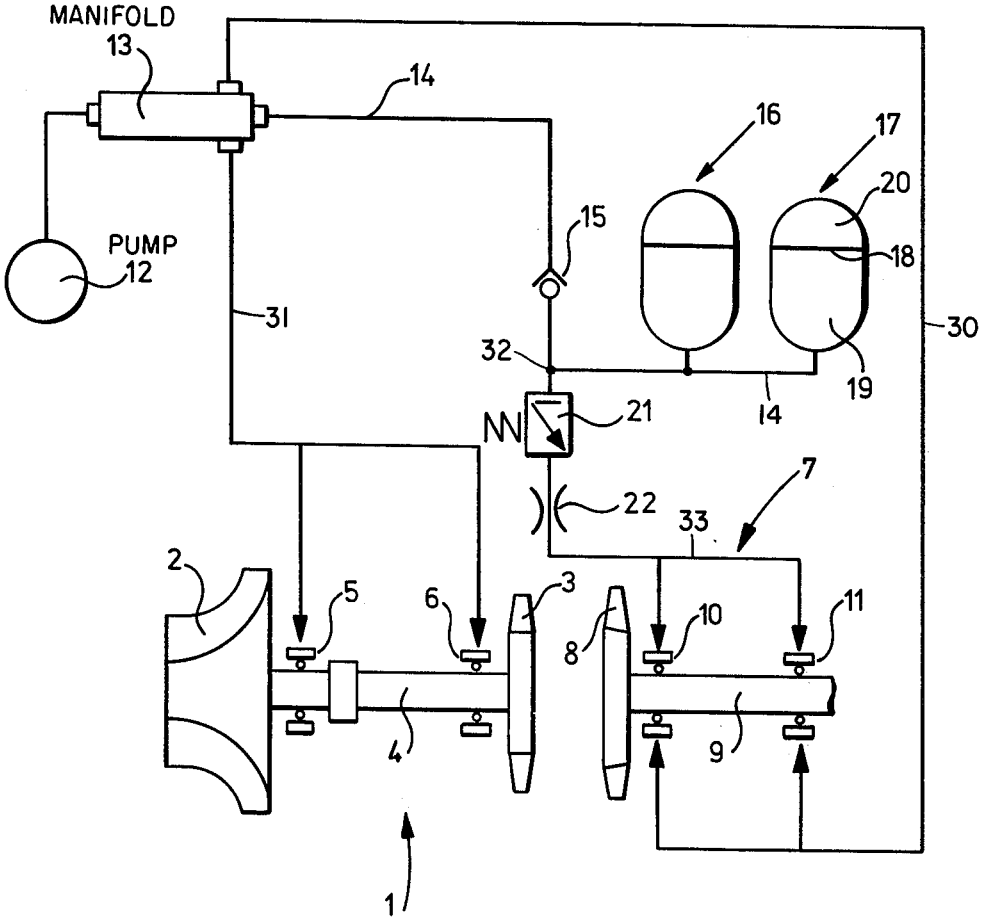
MANIFOLD
13
14
16
17
20
15
PUMP
12
18
31
30
32
19
21
14
7
22
33
2
5
6
3
10
11
8
4
9
1

VEHICULAR GAS TURBINE SYSTEM

This is a continuation, of application Ser. No. 710,291 filed July 30, 1976, now abandoned.

Vehicular gas turbine systems generally comprise a gas generator and a power turbine. The gas generator produces the gas to drive the power turbine and drives, apart from other accesories, a pump to deliver lubricant to the bearings of the gas turbine system. This also includes the bearings of the power turbine.

Then when a technical defect causes the gas generator to fail, the vehicle is immobilized and must be towed away. When the vehicle is being towed, the power turbine will idle. But as the failure of the gas generator has deactivated the oil pump, the flow of lubricant to the bearings of the power turbine is interrupted and the power turbine is damaged during towing as a result of seizing bearings. The practice with these systems is, therefore, not to tow the vehicle but to carry it piggy-back on a suitable vehicle. Yet, the vehicles powered by gas turbine systems normally being the large commercial type, this manner of salvaging immobilized vehicles is expensive and requires special salvage vehicles not always readily available.

To eliminate this disadvantage the practice has been to assign the power turbine an additional pump to serve the function of the gas generator driven oil pump when the vehicle is being towed and the power turbine is idling.

Inasmuch as vehicular gas turbine engines are in competition with the conventional internal combustion type and are relatively expensive because of the still small series, development must seek to economize costs wherever possible.

In a broad aspect the present invention provides a gas turbine system arranged such that it will permit the vehicle to be towed when the gas generator has failed and that the idling power turbine is safely supplied with lubricant at a minimum of additional provisions.

It is a particular object of the present invention to provide an arrangement where the pump connects not only to the lubricating points but also to a pressurized lubricant reservoir so that it will supply oil to the lubricating points and the lubricant reservoirs, with a shut-off valve between the reservoirs and the lubricating points to open in the event of pump failure.

In this arrangement additional lubricant is stored and pressurized in a lubricant reservoir and is allowed, when the oil pump fails and the power turbine revolves, to flow through the now open shut-off member as a result of the expanding pressurizing medium, and from there to the bearing points or the power turbine to prevent the bearings from running hot.

The shut-off member can in a simple fashion be designed for manual operation whenever required, but it would be helpful from the aspect of operational reliability to provide for automatic opening of the shut-off member when the pump fails and the power turbine keeps running.

In order that the pump will deliver lubricant to the reservoir only until its content is an allowable maximum, the oil pump is made to deliver the pressurizing medium to the reservoir or accumulator through a check valve which will close in both directions whenever a preselected pressure level has been obtained.

In a further aspect of the present invention this is achieved with maximum economy in that the pressurizing medium for positioning the guide vanes of the power turbine is provided in the lubricant reservoir or in that for lubricant, use is made of the pressurized oil used for varying the position of the power turbine guide vanes in normal operation. This dual function would be warranted in that the power turbine needs pressurizing medium in normal operation to position the guide vanes and the lubricant is directly provided by the oil pump, or in that the power turbine will idle only when the vehicle is being towed and when, therefore, the guide vanes will not need positioning.

In a still further aspect of the present invention the means to produce pressure in the lubricant reservoir is gaseous.

Further objects and advantages of the present invention will become apparent from the following description read in light of the accompanying drawing.

The gas turbine system comprises a gas generator 1, a compressor 2 and a turbine 3 of which are carried on a common shaft 4 supported in bearings 5 and 6. The power turbine 7 consists of a turbine wheel 8 arranged on a shaft 9 which is rotatably supported by bearings 10 and 11. The power impressed on shaft 9 by turbine wheel 8 serves to propel the vehicle in that it is transmitted to the driving wheels of the vehicle by means of suitable intermediate members. In the normal mode of operation gas generator 1 drives oil pump 12 which delivers oil under pressure to the bearings of both the gas generator and the power turbine through manifold 13. Manifold 13 is also provided with a line 14 connecting to two accumulators 16 and 17 through a check valve 15. In the normal mode of operation, oil pump 12 delivers oil under pressure, through manifold 13, not only to the gas generator and power turbine bearings but also to accumulators 16 and 17. Accumulators 16 and 17 are each divided into an oil chamber 19 and a sealed pressure chamber 20 by means of a diaphragm 18. When in the normal mode, oil under pressure is discharged into oil chambers 19, the pneumatic pressurizing means in the pressure chambers 20 is compressed and pressurized.

When the oil in oil chambers 19, and the compression of the pneumatic pressurizing medium in the pressure chambers 20, is an allowable maximum, the flow of lubricant to accumulators 16 an 17 is discontinued.

In the event of damage to the gas generator, then, the vehicle is temporarily immobilized. Apart from the gas generator, the power turbine and oil pump 12 connecting to it, are out of action. Then when the vehicle is being towed, the power turbine is driven from the driving wheels of the vehicle, but the flow of lubricant to its bearings 10 and 11 from oil pump 12, which is immobilized together with gas generator 1, is interrupted. In order to supply bearings 10 and 11 with oil, however, a shut-off valve 21 arranged between line 14 and bearings 10 and 11 is caused to open. The action of the expanding gas content in accumulator chambers 20 causes lubricant to flow, through a metering restrictor 22, from the oil chambers 19 to bearings 10 and 11. Suitable motoring provisions will then provide lubricant for the normal towing process.

What is claimed is:

1. A lubricating device for a gas turbine system including in combination a power turbine with a rotor, first shaft means and first bearing means supporting said power turbine rotor on said first shaft means; gas generator means, second shaft means and second bearing means supporting said gas generator means on said second shaft means, lubricant pump means (12. 13) driven by said gas generator means, first conduit means (30) directly connecting said lubricant pump means to said first bearing means (10, 11) for lubricating the latter during normal operation of the system, and second conduit means (31) directly connecting said pump means to said second bearing means (5, 6) for normally lubricating the second bearing means; said system further comprising accumulator tank means (16, 17), compressible means in said accumulator tank means for compression solely by said pump means, third conduit means (14) operatively connecting said accumulator tank means to said pump means to supply lubricant to said accumulator tank means and to thereby pressure load said accumulator tank means when the power turbine operates under normal operating conditions, fourth conduit means (33) connected to said first bearing means (10, 11), junction means (32) operatively connecting said fourth conduit means (33) to said third conduit means (14), valve means (21) located in said fourth conduit means between said junction and said first bearing means (10, 11), said pump means supplying lubricant to said first bearing means through said first conduit means (30) while simultaneously pressure loading said accumulator tank means through said third conduit means (14) during normal operation of said system, said compressible means in said accumulator tank means continuing the supply of lubricant to said first bearing means (10, 11) through said valve means (21) and through said fourth conduit means (33) after pump failure, wherein said valve means (21) is normally closed and opens in response to the stopping of said lubricating pump means (12, 13) to continue the supply of lubricant from said accumulator means (16, 17) when said pump means fail and the power turbine (8, 9) keeps running, said device further comprising check valve means (15) located in said third conduit means between said lubricant pump means and said accumulator tank means, said check valve means (15) closing in both directions when a preselected pressure level has been reached in said accumulator tank means.

2. The device of claim 1, wherein said accumulator tank means comprise an enclosed gas bubble (20) which is compressed solely by said pressure loading during normal operation of said lubricant pump means (12).

3. The device of claim 1, wherein said accumulator tank means serve as an auxiliary source of pressure when said pump means fail.

* * * * *